US007103305B2

(12) United States Patent
Koike et al.

(10) Patent No.: US 7,103,305 B2
(45) Date of Patent: Sep. 5, 2006

(54) DEVELOPING APPARATUS FOR IMAGE FORMING APPARATUS

(75) Inventors: Takayuki Koike, Kanagawa (JP); Nobutaka Takeuchi, Kanagawa (JP); Nobuo Iwata, Kanagawa (JP); Satoshi Muramatsu, Tokyo (JP); Junichi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 164 days.

(21) Appl. No.: 10/940,609

(22) Filed: Sep. 15, 2004

(65) Prior Publication Data

US 2005/0095037 A1 May 5, 2005

(30) Foreign Application Priority Data

Sep. 18, 2003 (JP) ..... 2003-325531

(51) Int. Cl.
*G03G 15/09* (2006.01)

(52) U.S. Cl. ..... 399/274

(58) Field of Classification Search ..... 399/222, 399/252, 259, 267, 274, 275; 430/107, 111
See application file for complete search history.

(56) References Cited

U.S. PATENT DOCUMENTS 4,106,611 A 8/1978 Suzuki et al.
4,126,400 A 11/1978 Suzuki et al.
4,160,200 A 7/1979 Imamura et al.
4,165,190 A 8/1979 Suzuki et al.
4,228,577 A 10/1980 Suzuki et al.
4,335,970 A 6/1982 Iwata et al.
4,411,539 A 10/1983 Iwata et al.
4,416,556 A 11/1983 Iwata et al.
4,436,440 A 3/1984 Iwata
4,572,682 A 2/1986 Iwata
4,747,710 A 5/1988 Iwata et al.
4,908,661 A 3/1990 Iwata et al.
4,983,055 A 1/1991 Iwata
5,008,711 A 4/1991 Sakamoto et al.
5,092,691 A 3/1992 Iwata
5,467,175 A 11/1995 Takagaki et al.
5,599,645 A 2/1997 Tamiya et al.
5,638,159 A 6/1997 Kai et al.
5,678,161 A 10/1997 Kurotaka et al.
5,797,074 A 8/1998 Kasahara et al.
5,799,228 A 8/1998 Iwata et al.
5,815,784 A 9/1998 Kasahara et al.
5,828,926 A 10/1998 Iwata et al.
5,875,380 A 2/1999 Iwata et al.
5,937,228 A 8/1999 Shoji et al.
5,953,567 A 9/1999 Muramatsu et al.
5,960,246 A 9/1999 Kasahara et al.
5,962,783 A 10/1999 Iwata et al.
5,963,240 A 10/1999 Shinohara et al.
5,987,298 A 11/1999 Muramatsu et al.
6,112,046 A 8/2000 Suzuki et al.
6,128,459 A 10/2000 Iwata et al.

(Continued)

*Primary Examiner*—Hoan Tran
(74) *Attorney, Agent, or Firm*—Oblon, Spivak, McClelland, Maier & Neustadt, P.C.

(57) ABSTRACT

A developing apparatus which uses a two-component developer consisting of a toner and carrier. The ratio between the amount of the developer M1 which is drawn onto a developing sleeve and refluxes while being regulated by a doctor blade, and the amount of the developer (drawn amount) M2 which passes through the doctor blade is M1/M2<10. The toner is a negatively-charged toner. In a charge amount distribution the number of toners of −1 fc/10 μm or more is 20% or less of the total number of toners.

10 Claims, 6 Drawing Sheets

U.S. PATENT DOCUMENTS 6,142,690 A 11/2000 Yoshimura et al.
6,163,669 A 12/2000 Aoki et al.
6,184,910 B1 2/2001 Sasaki et al.
6,201,941 B1 3/2001 Kasahara et al.
6,282,396 B1 8/2001 Iwata et al.
6,295,437 B1 9/2001 Hodoshima et al.
6,366,751 B1 4/2002 Shakuto et al.
6,381,435 B1 4/2002 Shinohara et al.
6,393,241 B1 5/2002 Matsumoto et al.
6,442,364 B1 8/2002 Kai et al.
6,507,720 B1 1/2003 Kbaumoto et al.
6,526,246 B1 2/2003 Iwata et al.
6,542,707 B1 4/2003 Muramatsu et al.
6,567,637 B1 5/2003 Yanagisawa et al.
6,571,076 B1 5/2003 Kasahara et al.
6,597,883 B1 7/2003 Muramatsu et al.
6,597,885 B1 7/2003 Kai et al.
6,608,983 B1 8/2003 Terazawa et al.
6,608,984 B1 8/2003 Matsumoto et al.
6,625,409 B1 9/2003 Shakuto et al.
6,628,908 B1 9/2003 Matsumoto et al.
6,628,913 B1 9/2003 Matsumoto et al.
6,628,915 B1 9/2003 Muramatsu et al.
6,654,579 B1 11/2003 Shakuto et al.
6,665,511 B1 12/2003 Takeuchi et al.
6,678,492 B1 1/2004 Terazawa et al.
6,696,211 B1 * 2/2004 Yoshida et al. ..... 430/108.3
6,748,190 B1 6/2004 Yamagisawa et al.
6,757,509 B1 6/2004 Shoji et al.
6,778,805 B1 8/2004 Kai et al.
6,785,496 B1 8/2004 Iwata et al.

* cited by examiner

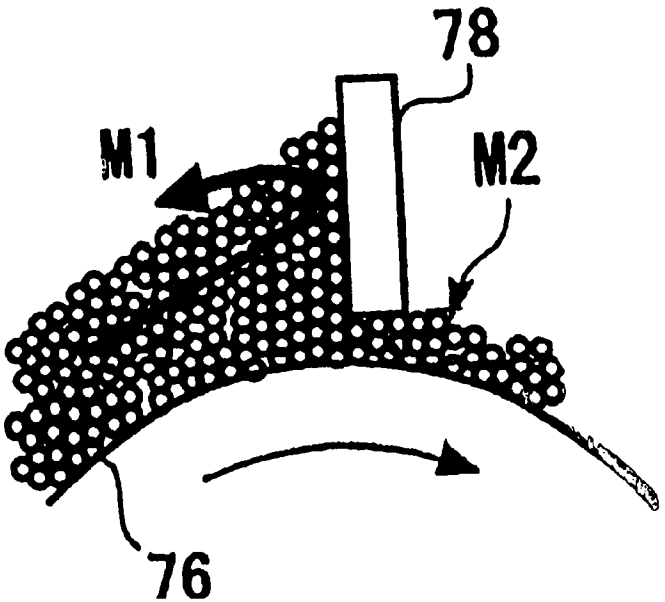
FIG. 3
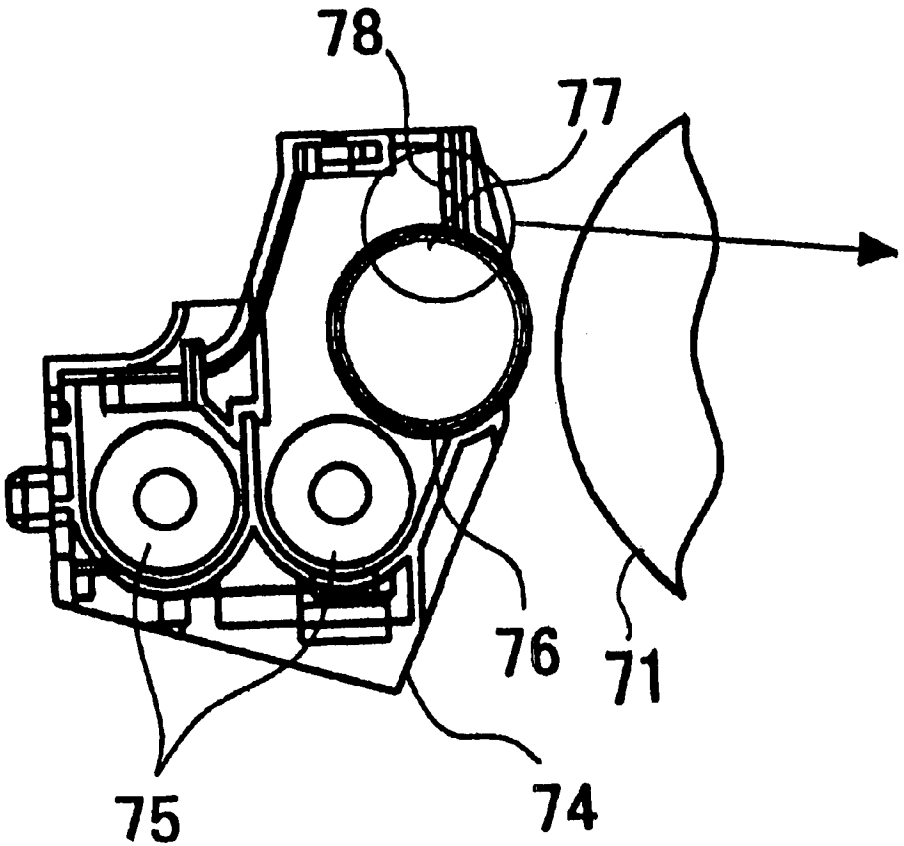

FIG. 5

| | M1 | DRAWN AMOUNT | | M1/M2 | LOW/OPPOSITE CHARGE TONER RATE (%) | | SOLID IMAGE DENSITY | | TONER SCATTERING | CONTAMI-NATION OF SURFACE |
|---|---|---|---|---|---|---|---|---|---|---|
| | | M2 | M2' | | BEFORE | AFTER | BEFORE | AFTER | | |
| CONDITION 1 | 325 | 60 | 59 | 5.4 | 5 | 6 | 1.5 | 1.5 | ○ | ○ |
| CONDITION 2 | 573 | 60 | 57 | 9.6 | 5 | 9 | 1.6 | 1.4 | ○ | ○ |
| CONDITION 3 | 691 | 60 | 32 | 11.5 | 5 | 24 | 1.5 | 1 | × | × |
| CONDITION 4 | 350 | 40 | 40 | 8.8 | 4 | 7 | 1.4 | 1.4 | ○ | ○ |
| CONDITION 5 | 500 | 40 | 24 | 12.5 | 4 | 31 | 1.6 | 1 | × | × |
| CONDITION 6 | 270 | 30 | 29 | 9.0 | 5 | 10 | 1.5 | 1.5 | ○ | ○ |
| CONDITION 7 | 440 | 30 | 17 | 14.7 | 5 | 33 | 1.5 | 0.7 | × | × |
| CONDITION 8 | 420 | 60 | 49 | 7.0 | 33 | 42 | 1.5 | 1.4 | × | × |
| CONDITION 9 | 360 | 40 | 30 | 9.0 | 29 | 37 | 1.4 | 1.2 | × | × |

DEVELOPING APPARATUS FOR IMAGE FORMING APPARATUS

BACKGROUND OF THE INVENTION

1. Field of the Invention

The present invention relates to a developing apparatus for a copier, facsimile apparatus, printer, or other similar image forming apparatus that uses an electrophotographic process, and also to a process cartridge comprising this developing apparatus.

2. Description of the Background Art

In the image forming apparatus, such as a copier, printer, or facsimile apparatus, which uses the electrophotographic process, it is important particularly to supply a developer to a development region between a photosensitive body and a developing sleeve in order to stably obtain, for long periods, a high-quality image with a good graininess of a halftone image, with the satisfied image density, and with no defects such as contamination of the surface. The amount of the developer supplied, i.e., the amount of the developer to be drawn, to the development region is set by a magnetic force of a magnetic roller inside the developing sleeve, as well as by the distance (doctor gap) between the developing sleeve and a developer amount regulating member (doctor blade). However, the amount often fluctuates over time due to change of the developer, which is caused because the developer constantly undergoes a stress generated from the doctor blade by repeated copying. Especially the drawn amount is reduced over time, which causes on an image a problem, such as an insufficient image density or traces of the carrier ear, and consequently the apparatus wears out.

In Japanese Patent Application Laid-Open No. 2000-47489, for example, the magnetic force distribution of a magnetic roller which acts as magnetic field generating means and is in the developing sleeve is optimized in order to stabilize, for long periods, the amount of the developer to be drawn; however, it is not taken into consideration that the condition of the developer changes because of repeated coping, thus it is understood that the effect of the optimization is not enough to stabilize the amount of the developer to be drawn.

SUMMARY OF THE INVENTION

An object of the present invention is to provide a developing apparatus capable of retaining a sufficient density by stably maintaining the amount of the developer to be drawn into the development region, and of stably obtaining a high-quality image which has no occurrence of toner scattering or no contamination of the surface but has an excellent graininess of a halftone image, even when copying is repeated for long periods, as well as to provide a process cartridge comprising such a developing apparatus.

In accordance with the present invention, a developing apparatus which uses a two-component developer consisting of a toner and carrier, comprising:

a developer support body which supports and rotates the developer;

a developer amount regulating member which regulates the amount of the developer on the developer support body to an appropriate amount; and screws for stir and convey the developer, wherein the ratio between the amount of the developer M1 which is drawn onto the developer support body and refluxes while being regulated by the developer amount regulating member, and the amount of developer (drawn amount) M2 which passes through the developer amount regulating member is M1/M2<10;

the toner is a negatively-charged toner; and in a charge amount (q/d) distribution the number of toners of −1 fc/10 μm or more is 20% or less of the total number of toners.

Further, in a process cartridge of the present invention, which integrally supports a photosensitive body and a developing apparatus which uses a two-component developer consisting of a toner and carrier, and which can be inserted to or removed from the main body of an image forming apparatus, the developing apparatus comprises:

a developer support body which supports and rotates the developer;

a developer amount regulating member which regulates the amount of the developer on the developer support body to an appropriate amount; and screws for stir and convey the developer, wherein the ratio between the amount of the developer M1 which is drawn onto the developer support body and refluxes while being regulated by the developer amount regulating member, and the amount of developer (drawn amount) M2 which passes through the developer amount regulating member is M1/M2<10;

the toner is a negatively-charged toner; and in a charge amount (q/d) distribution the number of toners of −1 fc/10 μm or more is 20% or less of the total number of toners.

Furthermore, an image forming apparatus of the present invention which uses a two-component developer consisting of a toner and carrier comprises:

a developer support body which supports and rotates the developer;

a developer amount regulating member which regulates the amount of the developer on the developer support body to an appropriate amount; and screws for stir and convey the developer, wherein the ratio between the amount of the developer M1 which is drawn onto the developer support body and refluxes while being regulated by the developer amount regulating member, and the amount of developer (drawn amount) M2 which passes through the developer amount regulating member is M1/M2<10;

the toner is a negatively-charged toner; and in a charge amount (q/d) distribution the number of toners of −1 fc/10 μm or more is 20% or less of the total number of toners.

BRIEF DESCRIPTION OF THE DRAWINGS

The above and other objects, features and advantages of the present invention will become more apparent from the following detailed description taken with the accompanying drawings in which:

FIG. 3 is a cross-sectional figure showing a configuration of the developing apparatus which uses a two-component developer consisting of a magnetic carrier and toner, according to the present invention;

FIG. 5 is a figure showing evaluation results for the toner scattering and contamination of the surface in each of the conditions.

DESCRIPTION OF THE PREFERRED EMBODIMENT(S)

Figure 1:
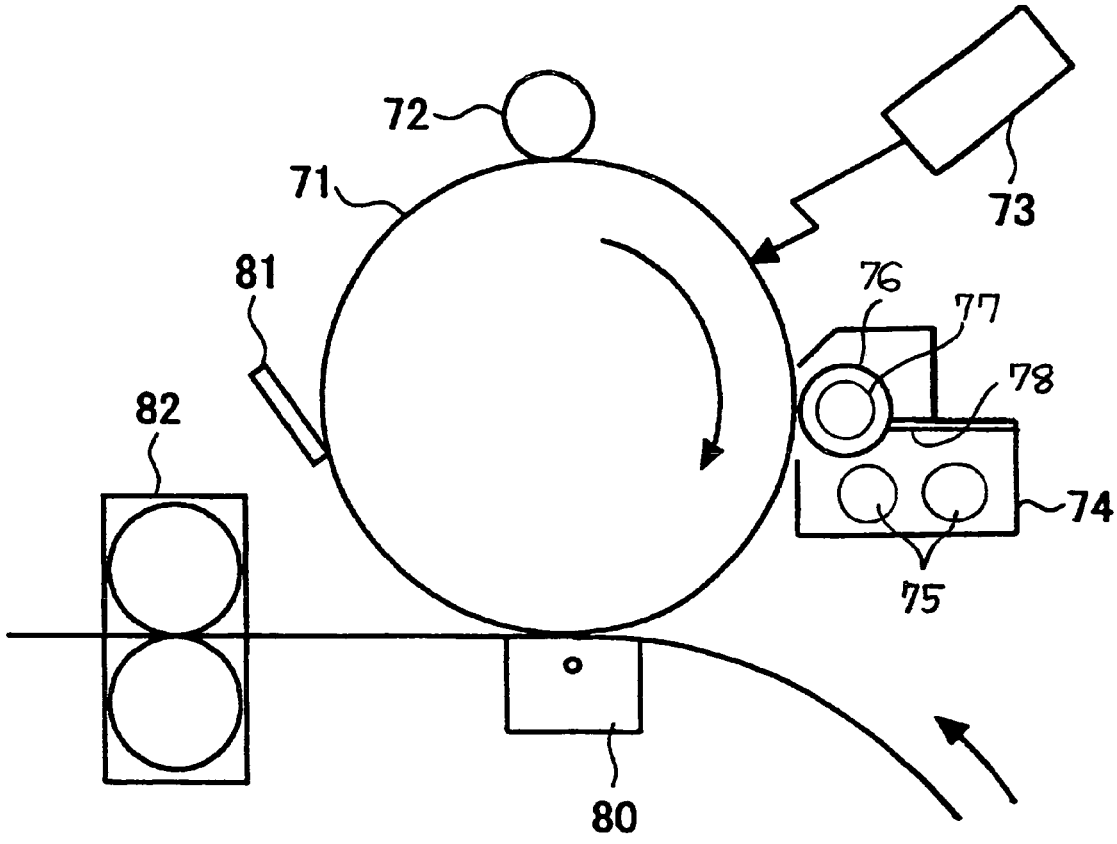
FIG. 1 PRIOR ART
FIG. 1 is a figure showing a schematic configuration of a main portion of a conventional image forming apparatus.
Figure 2:
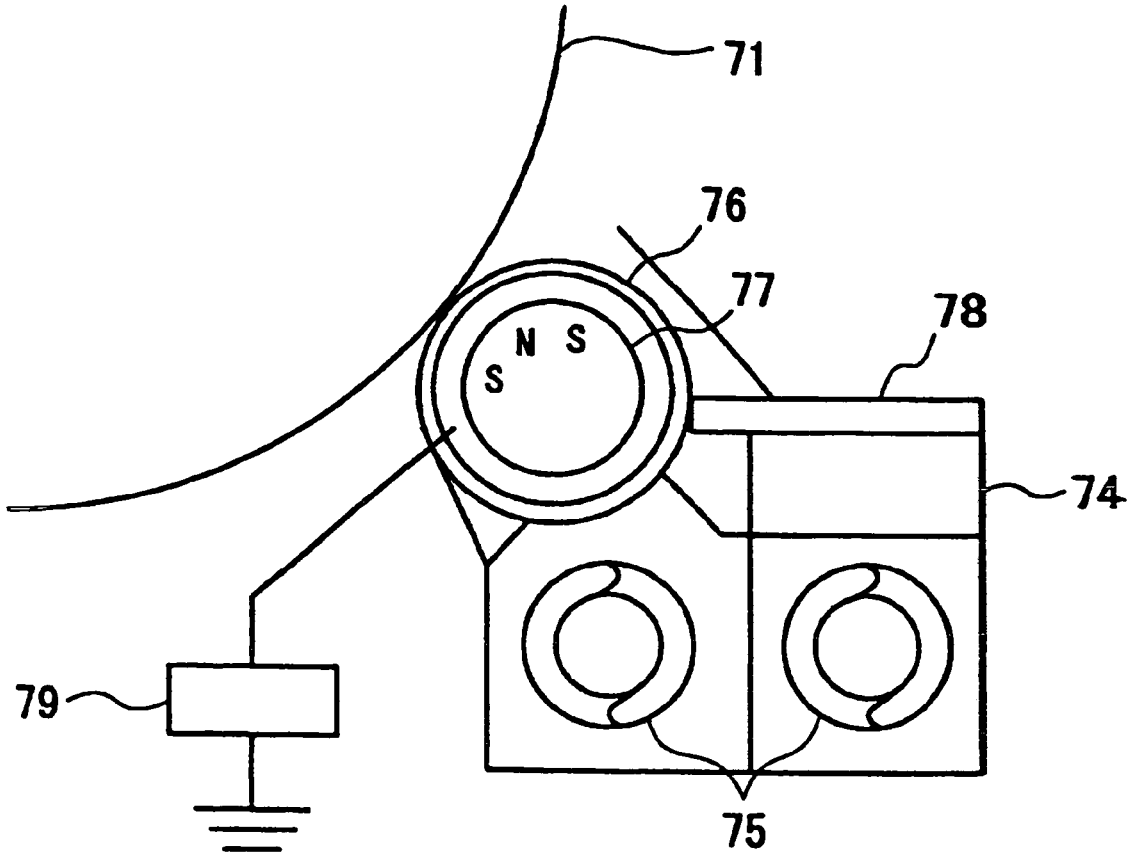
FIG. 2 PRIOR ART
FIG. 2 is a figure showing a schematic configuration of a developing apparatus of the image forming apparatus.

First of all, a conventional common electrophotographic process where a two-component developer is used is explained using FIGS. 1 and 2.

In FIGS. 1 and 2, an image support body, which is denoted by a number 71, is formed by applying the photosensitive body as a compress on the circumferential face of the body thereof, and is rotated by a drive mechanism which is not shown, in the direction of an arrow in the figure. This rotating photosensitive body 71 is first charged evenly to a desired electric potential by a charge device 72, and is then exposed to light by a photolithography machine 73, thereby forming an electrostatic latent image corresponding to an image. The electrostatic latent image formed on the photosensitive body 71 is made visible using a developing apparatus 74.

A developer consisting of a toner and carrier, which is used for development is stored in a developer storage of the developing apparatus 74, and rotatable screws 75 are disposed in the developer storage. The developer circulates evenly throughout the developer storage by means of these screws 75, and the toner is dispersed evenly to obtain a desired density and is charged by friction with the carrier. Further, a developing sleeve 76 is rotatably disposed in the upper portion of these screws 75 so as to face with the photosensitive body 71, keeping a predetermined distance therebetween. A magnetic roller 77 having N and S magnetic poles on its circumference is fixedly disposed inside the developing sleeve 76, and the developer is drawn by means of rotation of the developing sleeve 76 performed by the unshown drive mechanism. A doctor blade 78, which is a developer amount regulating member 78, for scraping off redundancy is further provided on the developing sleeve 76 in order to convey only a desired amount of the developer to a development region formed between the photosensitive body 71 and developing sleeve 76.

A voltage is applied to the developing sleeve 76 by a power supply 79. An electric field corresponding to an image is formed between the electrostatic latent image on the photosensitive body 71 and the developing sleeve 76, and the charge toner in the developer which is drawn onto the developing sleeve 76 adheres to the photosensitive body 71 by means of this electric field, whereby a toner image is formed.

The toner image that is developed as described above is transferred from the photosensitive body 71 onto a recording paper by a transfer device 80, and is fixed on the paper through heating or applying pressure to it while the recording paper passes through a fixing device 82. On the other hand, the toner, which remained on the photosensitive body 71 because it was not transferred to the recording paper, is removed by a cleaning member 81. Although the toner density in the developer decreases as the development is performed, a required amount of the toner is replenished by a toner replenish mechanism, which is not shown, as needed, so that image formation is performed repeatedly.

In the abovementioned image formation, it is particularly important to supply the developer to the development region formed between the photosensitive body 71 and developing sleeve 76 in order to stably obtain, for long periods, a high-quality image with a good graininess of a halftone image, with the satisfied image density, and with no defects such as contamination of the surface. As described above, the amount of the developer supplied, i.e., the amount of the developer drawn, to the development region is set by a magnetic force of the magnetic roller inside the developing sleeve 76, as well as by the doctor gap, which is the distance between the developing sleeve 76 and doctor blade 78. However, the amount often fluctuates over time due to change of the developer, which is caused because the developer constantly undergoes a stress generated from the doctor blade 78 by repeated copying. Especially the drawn amount is reduced over time, which causes in the image a problem, such as an insufficient image density or traces of the carrier ear, and consequently the apparatus wears out.

Therefore, in Japanese Patent Application Laid-Open No. 2000-47489, the magnetic force distribution of the magnetic roller which acts as magnetic field generating means and is in the developing sleeve is optimized in order to stabilize, for long periods, the amount of the developer to be drawn, as described above; however, it is not taken into consideration that the condition of the developer changes because of repeated copying, thus it is understood that the effect of the optimization is not enough to stabilize the amount of the developer to be drawn.

The embodiments of the present invention are explained in detail hereinbelow.

FIG. 3 shows a configuration of the developing apparatus which uses the two-component developer consisting of the magnetic carrier and toner, according to the present invention. The photosensitive drum 71 is formed from a photosensitive layer by coating an inorganic or organic photosensitive body with photosensitivity on an element tube made of aluminum or the like. The photosensitive layer is composed of a carrier generation layer and a carrier transport layer, and the surface of the photosensitive layer is charged evenly by the charge device. Note that a belt photoconductor may be used as the latent image support body.

The developing apparatus 74 comprises the chamber for the developer consisting of the toner and carrier. There are provided in the developer chamber the screws 75, which are rotary driven, in order to stir and convey the developer. The developing sleeve 76 is placed such that a part of it sticks out to the developing apparatus 74 from the part where the developing sleeve 76 faces the photosensitive drum 71. Partitioning walls are provided in developer conveying paths, which allow the toner to be replenished from an unshown toner replenishing opening of the conveying path away from the developing sleeve 76. By this means, the toner is mixed well with the carrier while being conveyed in a longitudinal direction, so that the unmixed toner obtained after replenishment is not supplied to the developing sleeve 76, thus the toner is delivered from the unshown opening to another conveying path to be drawn up to the developing sleeve 76.

The developing sleeve 76 is made of a material such as aluminum or non-magnetic stainless, is a cylindrical member having a moderate asperity on its surface, which is obtained by forming sandblasts and grooves, and is rotary driven at a suitable linear velocity by a rotary drive device which is not shown. Further, by fixedly disposing a magnetic member with a plurality of magnetic poles inside the developing sleeve 76, it is possible to hold the developer, as well as to convey and supply the developer to the electrostatic latent image on the photosensitive body. The magnetic roller 77 inside the developing sleeve 76 comprises a plurality of magnetic poles, each of which having an essential role to play. What is necessary are, basically, a development pole which forms the ear of the developer in the development region, a drawing pole which draws the developer onto the developing sleeve 76, and a conveying poly which conveys the developer. The magnetic roller 77 can be constituted by five to ten poles.

Moreover, the doctor blade 78 is placed as the developer regulating member on an upper stream side of the rotation direction of the developing sleeve 76 than the nearest point where the developing sleeve 76 contacts the photosensitive drum 71. After this doctor blade 76 regulates the amount of the developer on the developing sleeve 76 to a desired amount, a magnetic brush is formed by the magnetic roller 77 located inside the developing sleeve 76, and is brought into contact with the electrostatic latent image on the photosensitive drum 71. In addition, the power supply 79, which applies a developing bias voltage, for forming the developing electric field in the development region between the developing sleeve 76 and the photosensitive drum 71 is connected to the developing sleeve 76. This developing electric field allows the charge toner in the developer on the developing sleeve 76 to adhere to the electrostatic latent image on the photosensitive drum 71, whereby an image is formed.

It is preferred that the developing sleeve 76 be used at its linear velocity of from 1.1 to 3.0 times, and more preferably from 1.5 to 2.5 times with respect to the linear velocity of the photosensitive drum 71. When the developing sleeve 76 is used at or less than the linear velocity in the above range, the image density is insufficient; however if it is at or more than the range, toner scattering or image distortion occurs.

Further, for the development gap between the photosensitive drum 71 and developing sleeve 76, the optimal value thereof differs depending on the particle diameter of the carrier or the drawn amount ρ that are used; however, it is preferred that the photosensitive drum and developing sleeve be used in a narrow width from 0.2 mm to 0.5 mm for better development.

For the toner which is a constituent of the abovementioned developer is mixed with a conventionally known binding resin, wax component, or colorant, or, in other cases, with a charge control agent, or the like by using a mixer or the like, and after kneading the toner by using a kneader, such as a heated roll or extruder, the toner is cooled and solidified, which is then ground by means of grinding using a jet mill or the like to be sorted. The toner thus obtained may be used; however, in terms of an image and production cost, it is preferred to use a toner, which is obtained by using a polymerization method for easily producing a toner having a small diameter, a circular form, and a narrow distribution of the particle diameter.

It is preferred that the volume average particle diameter of the toner be 4 to 8 μm. It is generally said that the smaller the particle diameter of the toner the more advantageous in order to obtain a high-quality image with high resolution; however, it is often disadvantageous in terms of the transferability and cleaning property. In addition, the smaller the particle diameter of the toner becomes, the easier for the toner to be fused to the carrier surface, which accelerates the charging capacity of the carrier to decline. Moreover, when the particle diameter of the toner is larger than the above range, it is difficult to obtain an image with high resolution. The same can be said for the ratio between the volume average particle diameter and the number average particle diameter.

Further, it is suitable to develop an image with high resolution if the shape of the toner particle is as round as possible. Here, for the value indicating the shape of the toner, the average roundness can be measured as by using Flow Particle Image Analyzer FPIA-1000 (To a Medical Electronics Co., Ltd.) In a specific measurement method, 0.1 to 0.5 ml of a surfactant or preferably alkyl-benzene sufonate is added as a dispersant, and further approximately 0.1 to 0.5 g of a measurement sample is added, into 100 to 150 ml of water in a container from which impure solid matters are removed in advance. A suspension in which the sample is dispersed can be obtained by subjecting it to dispersion processing for approximately 1 to 3 minutes in an ultrasonic dispersing machine, and then measuring the shape and distribution of the toner by means of the abovementioned analyzer, with having 3000 to 10000/μl of the density of the dispersions.

Preferably, silica, alumina, titanium oxide or other inorganic fine particle can be used as an external additive for supporting the electrification characteristic. Preferably the primary particle of this inorganic fine particle is 5 mμ to 2 μm, and more preferably 5 mμ to 500 μm. Further, it is preferred that the specific surface area obtained using the BET method be 20 to 500 $m^2/g$. The rate at which this inorganic particle is used is preferably 0.01 to 5% by weight, more preferably 0.5 to 3.0% by weight, of the toner.

Consequently, by reducing the particle diameter of the toner to obtain narrow particle diameter distribution, and also by mixing it with the abovementioned additive, the charge amount distribution can also be narrowed, which enables more even development of the image, thereby improving the graininess of the halftone image or the like.

The ratio between the carrier and toner contained in the developer is preferably 100 parts by weight for the carrier and 1 to 10 parts by weight for the toner. For a magnetic carrier, an iron powder, ferrite particle, magnetite particle, magnetic resin carrier, or other conventionally known carrier having a particle diameter of approximately 20 to 200 μm can be used. Furthermore, for a covering material, amino resin, polyvinyl and polyvinylidene resin, polystylene resin, silicone resin, and the like can be used. The embodiment described below was performed by using a carrier having a particle diameter of 35 μm; however, 20 μm to 100 μm is appropriate, and 30 μm to 60 μm is preferred. The toner can be charged evenly by reducing the particle diameter and increasing the surface area of the carrier according to the particle diameter of the toner.

However, as with the particle diameter of the toner, although a latent with high resolution can be developed smoothly if the particle diameter of the carrier is as small as possible, if it is too small, carrier scattering or carrier adhesion occurs, which is unfavorable. In the configuration described above, the change of the drawn amount of the developer, which occurs when copying is performed repeatedly for long periods, is analyzed by focusing particularly on the change of the charge amount distribution of the toner, and on the stress on the developer. As a result, it was discovered that the temporal fluctuation of the drawn amount is largely associated with a low charge amount component of the toner, and that the stress from the doctor blade 78 largely contributes to the increase of the low charge amount of the toner.

The reasons that the low charge or opposite charge of the toner generates can be considered as follows. Specifically, a desired charge amount is given to the toner in the developer, and this toner is conveyed to the development region in a sate where it adheres electrically and physically to the carrier, and is then forced by the electric field to move to the electrostatic latent image on the photosensitive body. At this moment, however, all the toner in the developer conveyed to the development region is not necessarily used for image formation, depending on the latent image potential or the development electric field. Particularly, since the force of the electric field which is applied to the toner in the vicinity of the developing sleeve 76 is weak, it ends up repeating a step in which the majority of the force once separates from the sleeve that rotates while the toner adheres to the carrier, and thereafter the developer is drawn again and conveyed to the development region.

When the developer passes through the doctor blade 78, it suffers a strong stress while being brought into a high compression, thus the abovementioned toner becomes almost a toner matrix because the external additive that existed on the surface of the toner is immersed into or removed from the toner matrix. In the toner where the additive no longer exists on its surface, the area where the toner contacts the carrier becomes large, the adherence on the carrier increases, whereby it is difficult for the toner to be replaced with a newly replenished toner. In this case, it is difficult for the newly replenished toner to contact the carrier, which results in that the charge is not applied and the charge amount decreases.

Moreover, the toner that was replenished later to increase the chance to contact the old toner can easily hold the opposite charge. Alternatively, the toner ends up floating in the developer without being held by the carrier while holding the opposite charge.

Also, in the developer subjected to the stress repeatedly for long periods, the toner component is fused and melted in the surface of the carrier, whereby it is difficult to further apply the necessarily enough charge amount to the toner, which leads to the abovedescribed causes and generation of the low/opposite charge or floating toner.

The developer drawn onto the developing sleeve 76 forms the magnetic brush on the sleeve and is conveyed by a magnetic force generated from the magnetic roller inside the sleeve and by the frictional force of the sleeve surface. After being regulated to an appropriate amount by the doctor blade 78, the developer is conveyed to the development region; however, when there are existing many toners that are applied with the abovementioned low charge or opposite charge, and that adheres lightly to or float in the carrier, the developer slips easily on the sleeve surface, and further, the carrier ear is cut easily, which reduces the amount of the developer passing the state of being compressed before the doctor blade 78, thereby resulting in an insufficient developer to be conveyed to the development region. Such situation tends to happen due to the above causes after, especially, repeated copying. In the space initially established between the doctor blade 78 and developing sleeve 76, because of the change (decrease) of the drawn amount, which is caused by the increase of the low/opposite charge of the toner, the problems are generated, such as decrease of the image density, toner scattering, and contamination of the surface.

Therefore, in the development method and developing apparatus 74 of the present invention, first of all, assume that the ratio between the amount of the developer M1 which is drawn onto the developing sleeve 76 and refluxes while being regulated by the doctor blade 78, and the drawn amount M2 which passes through the doctor is M1/M2<10. Thus, by reducing the amount of developer other than the developer actually conveyed to the development region, it is possible to reduce the state where the developer is compressed on the side before the doctor blade 78, and to reduce the stress on the developer. At the same time, assume in the charge amount (q/d) distribution that the number of toners of −1 fc/10 μm or more is 20% or less of the total number of toners.

According to the present invention, it is discovered that, by reducing the stress on the developer, preventing the generation of toner of the low/opposite charge amount, and maintaining the state in which the rate of the toner of the low charge opposite charge is less, the amount of the developer conveyed to the development region can be kept to the same amount established initially, whereby an image with high resolution can be obtained for long periods. Furthermore, by using the magnetic material in a part of or the entire doctor blade 78, the above effects become remarkable. When using the magnetic material, a magnetic flux generated from the magnetic poles inside the developing sleeve 76, which are adjacent to the doctor blade 78, concentrate onto the doctor blade 78, whereby it is possible to expand and use the space between the developer support body and doctor blade 78, compared to when the magnetic material is not used.

Now, the measurement method for the charge amount distribution of the toner is described.

As the measurement method of the charge amount distribution of the toner, there has been known a method in which Charge Spectrum Method is used, and a method in which a laser Doppler velocimeter is used, and any of these measurement methods can be used; however, the method here indicates the measurement method of the charge amount distribution of the toner in a device for measuring the charge amount distribution of the toner particles (E-Spurt Analyzer: Hosokawa Micron Co., Ltd.), in which the laser Doppler velocimeter is used. First, the developer is held on the developer hold board constituted by a magnet. Next, the developer held by the developer hold board is split into the magnetic carrier and a toner by means of an air gun (nitrogen gas), thereby suctioning and introducing the toner particles only to a measuring portion. The toner particles introduced to the measuring portion are sequentially subjected to the charge measurement to obtain the charge amount distribution of the toner. Note that the measurement conditions are assumed as follows:

Blow pressure of the nitrogen gas: 0.4 $Kg/cm^2G$

Blowing time of the nitrogen gas: 2 seconds

Interval of the nitrogen gas blow: 2 seconds

Number of rotations of the developer hold board: 320 rpm

Figure 4:
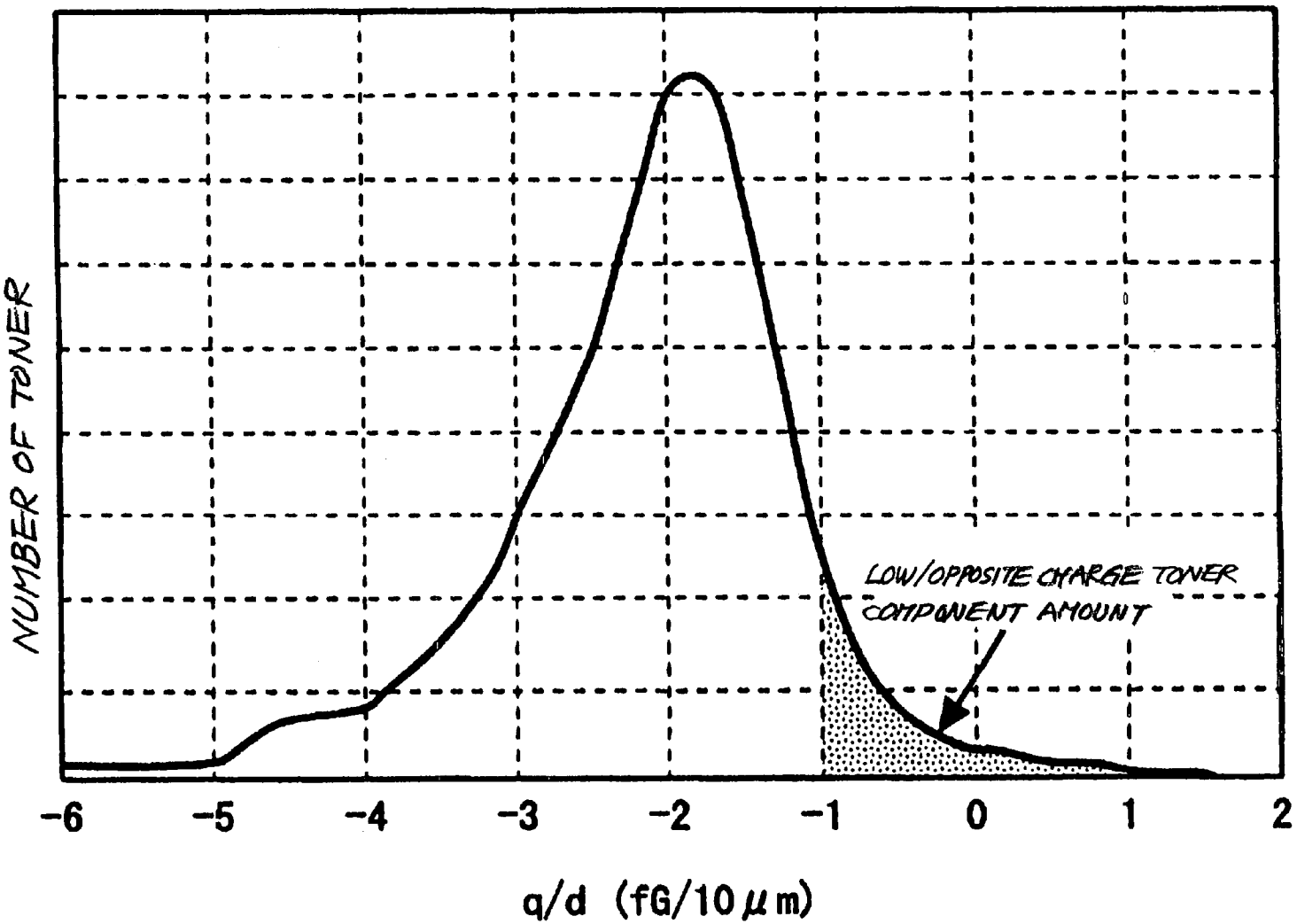
FIG. 4 is a figure showing a charge amount distribution of a negatively-charged toner obtained by a measurement method where a laser Doppler velocimeter is used.

FIG. 4 shows the charge amount distribution of the negatively-charged toner, which is obtained using the abovementioned measurement method. The horizontal axis indicates the amount obtained by dividing the toner charge amount q by the toner particle diameter d, while the vertical axis indicates the number of toners. Here, the low charge toner means the toner with −1 fc/10 μm to 0 fc/10 μm, while the opposite charge toner means the positively-charged toner with 0 fc/10 μm or more. When defining the low/opposite charge amount toner as described above, the component thereof is the shaded area in the figure, and is expressed in percentage as the ratio between the total number of toners used in measuring and the sum of the number of toners that are −1 fc/10 μm.

Next, the present invention will be explained in further detail with the embodiments, but the present invention is not limited to these.

In the present embodiment, evaluation is carried out with respectively changed in an experimenting machine, thereby judging the whether the results are good or bad. The conditions for the experiment are described hereinbelow.

The proximal distance between the developing sleeve 76 and photosensitive drum 71 is 0.3 mm; the photosensitive body diameter is 30 mm; the linear velocity of the photosensitive body is 240 mm/sec; the developing sleeve diameter is 18 mm; the linear velocity of the developing sleeve is 408 mm/sec; the particle diameter of the toner used is 5.5 μm; the roundness is 0.98; the volume average particle diameter divided by the number average particle diameter is 1.15; the particle diameter of the carrier is 35 μm; and the total amount of the developer inside the developing apparatus 74 is 280 g. In addition to these basic configuration, as shown in Table 1, the ratio between the amount of the developer M1 which refluxes while being regulated by the doctor blade 78, and the drawn amount M2, as well as the conditions 1 though 9, where the toner with different charge amount distribution is used, are evaluated.

By using the experimenting machine established for each condition, continuous outputting of 100000 images is performed using a chart of a 5% image area ratio, to evaluate the items shown hereinbelow.

<Drawn Amount>

In the experimenting machine, the drawn amount M2 ($mg/cm^2$) before the continuous run of the machine, as well as the drawn amount M2' ($mg/cm^2$) after the continuous run are measured.

<Low/Opposite Charge Toner Rate:>

The E-Spurt Analyzer is used before and after the continuous run to measure the charge amount distribution of the toner, and the content of the toner with −1 fc/10 μm or more is measured.

<Image Density>

The solid image density before and after the continuous run is measured using a spectrocolorimeter X-Rite. If the density is 1.4 or more, there is no problem in the density.

<Toner Scattering, Contamination of the Surface>

A contamination inside the machine after the continuous run, as well as contamination of the surface of the background of the image are visually evaluated as ○: good; Δ: OK; and X: no good.

The evaluation results for the respective conditions are shown in FIG. 5.

In the conditions 1, 2, 4, and 6, when an excess amount of the developer is conveyed, it does not pass through the doctor blade, thus the stress on the developer is small. As a result, the increase of the low/opposite charge toner rate was controlled, and the decrease of the drawn amount was not observed, whereby it was possible to obtain the image density that is always stable. Furthermore, it was possible to output a high-quality image with no toner scattering and contamination of the surface for long periods.

In the conditions 3, 5, and 7, on the other hand, the developer has suffered a large stress because the excess developer was supplied before the doctor blade 78, whereby the low/opposite charge toner has increased over time, the image density has decreased due to the decreased drawn amount, and bad results of the toner scattering and contamination of the surface were obtained. Moreover, in the conditions 8 and 9, although the stress on the developer is reduced, there were existing many low/opposite charge toners from the initial period, thus they have further increased over time. Therefore, extremely bad results of the toner scattering and contamination of the surface were obtained.

Figure 6:
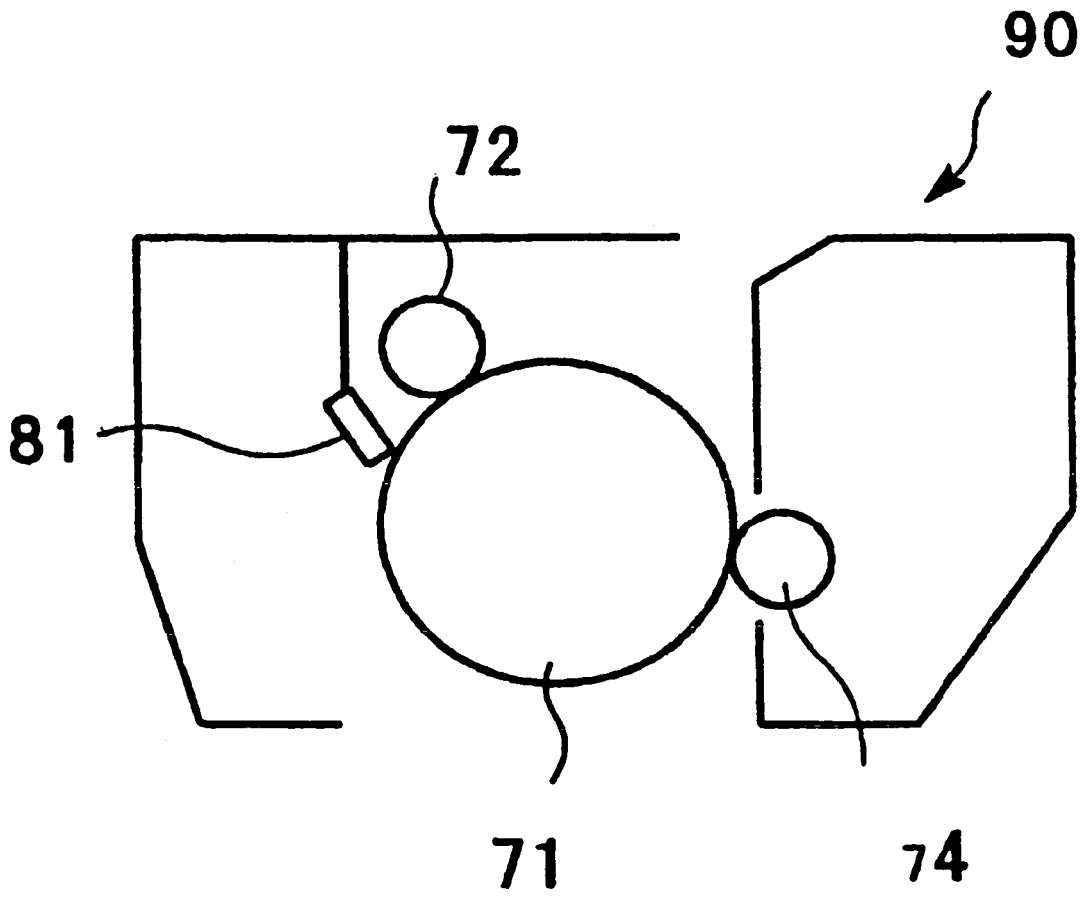
FIG. 6 is a figure showing a schematic configuration of the image forming apparatus which uses a process cartridge comprising the developing apparatus.

FIG. 6 shows a schematic configuration of the image forming apparatus having a process cartridge. In the image forming apparatus having a process cartridge which applies the developing apparatus 74 of the present invention, the photosensitive body is rotary driven at a predetermined peripheral velocity. In the rotation process, the photosensitive body is charged evenly at a predetermined positive or negative potential on the circumferential face thereof by charging means, and is then subjected to an image exposure from image exposure means, such as slit exposure, laser beam scanning exposure, or the like, whereby electrostatic latent images are sequentially formed on the circumferential face of the photosensitive body. The electrostatic latent images thus formed are then subjected to toner development by development means. The developed toner images are sequentially transferred by transfer means to a transferred material, which was synchronized with the rotation of the photosensitive body and fed from a paper feeding portion to the space between the photosensitive body and the transfer means. The transferred material which was subjected to the image transfer separates from the surface of the photosensitive body, is introduced to image fixing means to be fixed as an image, and is then printed out as a copy to the outside the apparatus. After the image transfer, the surface of the photosensitive body is cleaned by being subjected to removal of the toner which is remained after the transfer, by cleaning means, is further subjected to static elimination, and thereafter is used for image formation repeatedly.

As is clear from the above detailed and specific explanation, in the development method and developing apparatus of the present invention, by using the developer having less low/opposite charge toner, as well as by preventing the generation of the low/opposite charge toner with reducing the stress on the developer, it is possible to prevent the drawn amount from being reduced over time, thereby obtaining a stable image density. At the same time it is possible to obtain an image with an excellent graininess of a halftone image without causing toner scattering or contamination of the surface. Therefore, a good image quality can be maintained for long periods.

Various modifications will become possible for those skilled in the art after receiving the teachings of the present disclosure without departing from the scope thereof.

What is claimed is:

1. A developing apparatus which uses a two-component developer consisting of a toner and carrier, comprising:

a developer support body which supports and rotates the developer;

a developer amount regulating member which regulates the amount of the developer on the developer support body to an appropriate amount; and screws for stir and convey the developer, wherein the ratio between the amount of the developer M1 which is drawn onto the developer support body and refluxes while being regulated by the developer amount regulating member, and the amount of developer (drawn amount) M2 which passes through the developer amount regulating member is M1/M2<10;

said toner is a negatively-charged toner; and in a charge amount (q/d) distribution the number of toners of −1 fc/10 μm or more is 20% or less of the total number of toners.

2. The developing apparatus as claimed in claim 1, wherein a magnetic material is used in a part or in the whole of said developer amount regulating member.

3. The developing apparatus as claimed in claim 1, wherein said toner is obtained by dissolving or dispersing in an organic solvent a toner composition which comprises at least a modified polyester resin which can be urea-bonded and wax as a separating agent, so as to disperse the dissolved or dispersed matter in a water-type medium and to subject same to polyaddition reaction, thereby removing the solvent of the dispersions and cleaning same.

4. The developing apparatus as claimed in claim 1, wherein the volume average particle diameter of a particle of said toner is 4 to 8 μm.

5. The developing apparatus as claimed in claim 1, wherein the value obtained by dividing the volume average particle diameter by the number average particle diameter for said toner is 1.20 or less.

6. The developing apparatus as claimed in claim 1, wherein the roundness of said toner particle is 0.95 or more to less than 1.00.

7. The developing apparatus as claimed in claim 1, wherein an inorganic fine particle is used as an external additive of said toner.

8. The developing apparatus as claimed in claim 1, wherein the weight average particle diameter of said carrier is 40 μm or less.

9. A process cartridge, which integrally supports a photosensitive body and a developing apparatus which uses a two-component developer consisting of a toner and carrier, and which can be inserted to or removed from the main body of an image forming apparatus, the developing apparatus comprising:

a developer support body which supports and rotates the developer;

a developer amount regulating member which regulates the amount of the developer on the developer support body to an appropriate amount; and screws for stir and convey the developer, wherein the ratio between the amount of the developer M1 which is drawn onto the developer support body and refluxes while being regulated by the developer amount regulating member, and the amount of developer (drawn amount) M2 which passes through the developer amount regulating member is M1/M2<10;

said toner is a negatively-charged toner; and in a charge amount (q/d) distribution the number of toners of −1 fc/10 μm or more is 20% or less of the total number of toners.

10. An image forming apparatus which uses a two-component developer consisting of a toner and carrier, comprising:

a developer support body which supports and rotates the developer;

a developer amount regulating member which regulates the amount of the developer on the developer support body to an appropriate amount; and screws for stir and convey the developer, wherein the ratio between the amount of the developer M1 which is drawn onto the developer support body and refluxes while being regulated by the developer amount regulating member, and the amount of developer (drawn amount) M2 which passes through the developer amount regulating member is M1/M2<10;

said toner is a negatively-charged toner; and in a charge amount (q/d) distribution the number of toners of −1 fc/10 μm or more is 20% or less of the total number of toners.

* * * * *